US005836094A

United States Patent [19]

Figel

[11] Patent Number: 5,836,094

[45] Date of Patent: Nov. 17, 1998

[54] BICYCLE SHOE INCLUDING UNIT BODY

[76] Inventor: Nicholas H. Figel, Rte. 1, Box 186, Highlands, N.C. 28741

[21] Appl. No.: 867,371

[22] Filed: Jun. 2, 1997

[51] Int. Cl.[6] ..... A43B 5/00; A43B 5/14

[52] U.S. Cl. ..... 36/131; 36/25 R; 36/68

[58] Field of Search ..... 36/131, 128, 25 R, 36/28, 54, 68

[56] References Cited

U.S. PATENT DOCUMENTS

| | | | |
|---|---|---|---|
| 2,814,133 | 11/1957 | Herbst | 36/25 R |
| 3,193,948 | 7/1965 | Roberts . | |
| 3,668,793 | 6/1972 | Stohr et al. . | |
| 4,114,297 | 9/1978 | Famolare, Jr. . | |
| 4,308,672 | 1/1982 | Antonious . | |
| 4,361,972 | 12/1982 | Miller | 36/131 |
| 4,547,983 | 10/1985 | Brandt | 36/131 |
| 4,622,764 | 11/1986 | Boulier | 36/68 |
| 4,642,914 | 2/1987 | Caldeira . | |
| 4,679,335 | 7/1987 | Berlese | 36/131 |
| 4,815,222 | 3/1989 | Eisenbach et al. | 36/131 |
| 4,825,565 | 5/1989 | Bigolin | 36/131 |
| 4,845,864 | 7/1989 | Corliss | 36/131 |
| 5,086,576 | 2/1992 | Lamson | 36/131 |
| 5,125,173 | 6/1992 | Nagano et al. | 36/131 |
| 5,131,291 | 7/1992 | Beyl | 36/131 |
| 5,218,773 | 6/1993 | Beckman | 36/68 |
| 5,280,680 | 1/1994 | Burke et al. | 36/28 |
| 5,363,526 | 11/1994 | Okajima | 36/131 |
| 5,406,723 | 4/1995 | Okajima | 36/131 |
| 5,433,021 | 7/1995 | Mahler . | |
| 5,446,977 | 9/1995 | Nagano et al. . | |
| 5,513,450 | 5/1996 | Aviles Palazzo | 36/128 |
| 5,528,842 | 6/1996 | Ricci et al. . | |
| 5,598,645 | 2/1997 | Kaiser | 36/28 |
| 5,659,982 | 8/1997 | Muraoka et al. | 36/131 |

FOREIGN PATENT DOCUMENTS

| | | | |
|---|---|---|---|
| 553934 | 8/1993 | European Pat. Off. | 36/131 |
| 2683981 | 5/1993 | France | 36/131 |
| 405176802 | 7/1993 | Japan | 36/131 |

*Primary Examiner*—M. D. Patterson
*Attorney, Agent, or Firm*—Carter & Schnedler, P.A.

[57] ABSTRACT

A cycling shoe having the characteristics of stiffness, low weight, foot stability and walking comfort has as its primary element a unit body of monocoque construction in the form of a contoured sheet, for example of fiber and resin composite, that replaces the sole and part of the upper of a traditional shoe. The unit body includes a sole portion and a perimeter region. A downwardly-extending ridge structure defines a substantial portion of the perimeter region. An upwardly-extending sidewall terminates the perimeter region, and forms a portion of the shoe upper. Shoe upper components include a stiffened and contoured tongue piece and adjustable straps for pressing the tongue piece down against the forefoot of the cyclist.

15 Claims, 9 Drawing Sheets

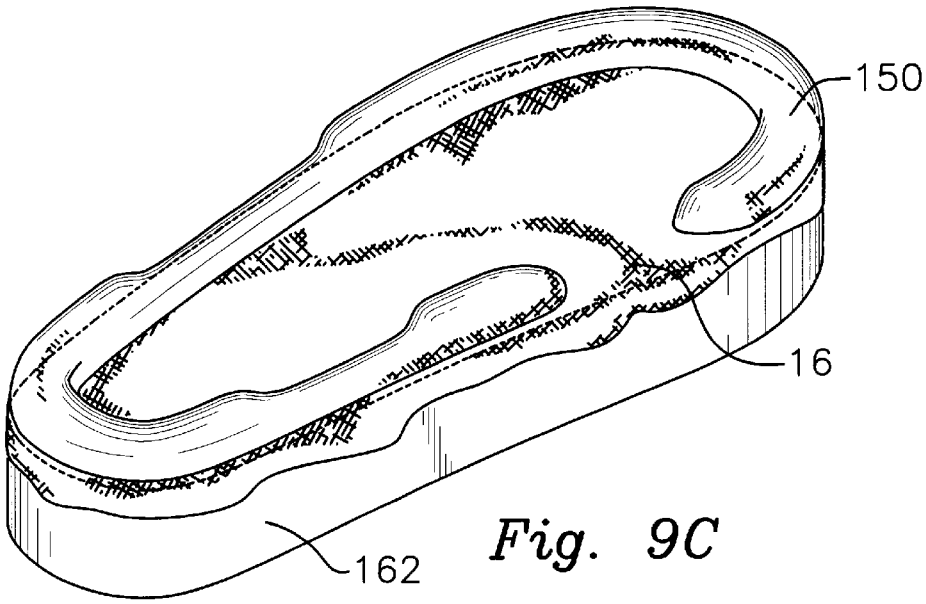
Fig. 9C
Fig. 9D
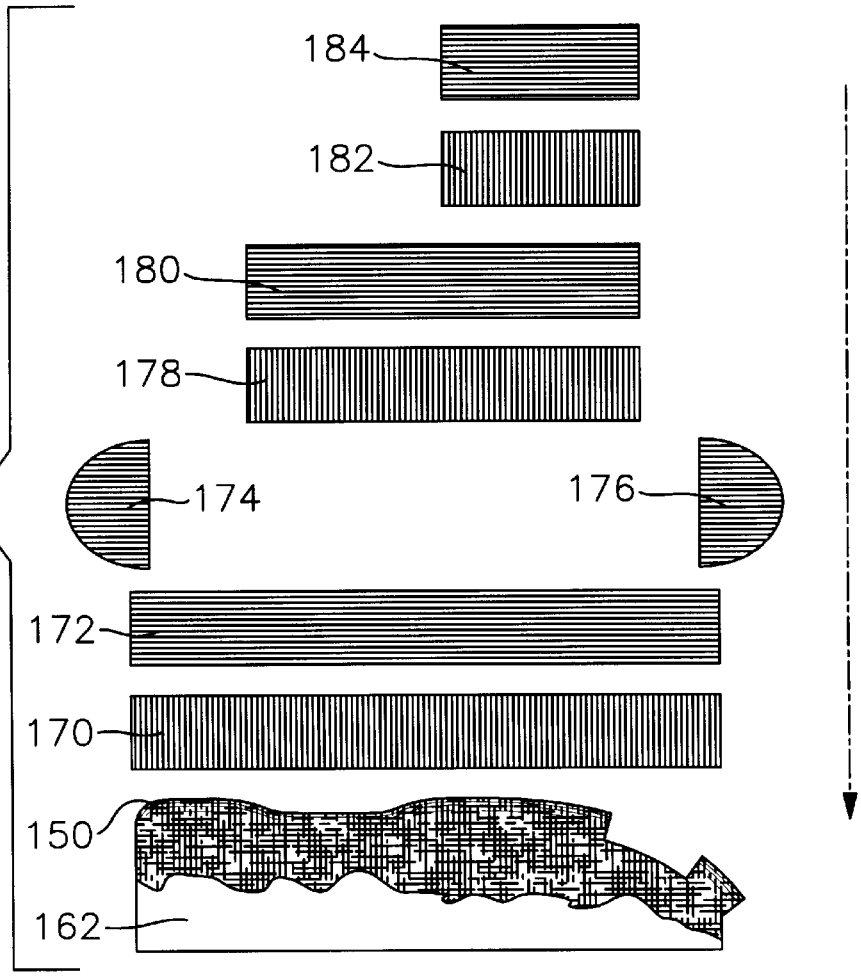

BICYCLE SHOE INCLUDING UNIT BODY

BACKGROUND OF THE INVENTION

The present invention relates generally to cycling shoes, and more particularly, to a cycling shoe which advantageously achieves the characteristics of stiffness, low weight, foot stability and walking comfort.

Modern cycling shoes are mechanically engaged to a bicycle through a locking type pedal which has a secondary component, known as a cleat, attached to the sole of the shoe. Pedal manufacturers use varying, and often proprietary, styles of pedal cleats.

Typical prior art cycling shoes are constructed primarily of two components: a rigid sole piece, and a non-rigid upper.

The sole piece is rigid in order to efficiently transfer energy from the foot into the bicycle pedal. To achieve the required stiffness, sole pieces are usually relatively thick in the vertical dimension. In addition to stiffness, another desirable characteristic of cycling shoes, (common to bicycle components in general) is the lightest possible weight consistent with the structural purpose.

A more subtle characteristic by which cycling shoes; may be evaluated is sole thickness. A thinner sole places the foot of the cyclist closer to the pedal, improving efficiency and lowering center of gravity. Typical prior art sole thickness, expressed as cleat-to-foot clearance, are in the order of 12 to 15 mm.

Typical non-rigid shoe uppers include one or more retention devices, such as hook and loop straps, plastic straps, laces, and the like, in an attempt to stabilize the foot of the cyclist with reference to the sole.

Thus another characteristic desirable in cycling shoes is a stable interface between the foot of the cyclist and the shoe. Traditionally, this is accomplished in a road bike shoe by providing a relatively narrow plastic shell into which the foot of the cyclist is forced, to be laterally held.

Cycling shoes are generally available in two different types, mountain cycling shoes and road cycling shoes.

Prior art mountain cycling shoes generally include an additional rubber or synthetic rubber tread to facilitate comfortable and capable walking. Moreover, the tread is of sufficient thickness so that the cleat is recessed and not in contact with the ground when during those times when the cyclist is walking. To further enhance walkability, the sole of mountain cycling shoes is slightly flexible in the forefoot.

Prior art road cycling shoes are substantially rigid throughout the sole and have few concessions to walking comfort. Normally, only minimal tread is added, and the cleat is in contact with the surface of the ground when the rider is walking, resulting in less comfortable walking, and wear on the cleat.

SUMMARY OF THE INVENTION

Accordingly, it is an object of the invention to provide a cycling shoe which is useful either as a mountain cycling or a road cycling shoe, which has an improved stiffness to weight ratio, and which provides walking convenience.

It is yet another object of the invention to provide a cycling shoe which is compatible with a variety of different cleat types, from different manufacturers.

It is a related object of the invention to provide a cycling shoe which has a recessed cleat feature.

It is another object of the invention to provide a cycling shoe with a low stack height.

It is another object of the invention to provide improved stabilization of the foot of the cyclist into the shoe, for improved efficiency.

Briefly, the cycling shoe of the invention includes as its primary element a unit body of monocoque construction, in the form of a contoured sheet which replaces the sole and part of the upper of a traditional shoe. In the disclosed embodiment, the unit body is made of a fiber and resin composite, including carbon fibers. However, the unit body may also be made of injection molded plastic, with or without embedded fibers for enhanced strength and thickness. In the disclosed embodiment, the unit body varies in thickness from a minimum of approximately 0.04 inches to a maximum of 0.11 inches, depending upon structural strength requirements at particular locations.

The unit body more particularly includes a sole portion having an intermediate region and a perimeter region. A downwardly-extending ridge structure that is generally semi-circular in cross-section extends along and defines a substantial portion of the perimeter region. Preferably the downwardly-extending ridge structure comprises an outer skin, which provides the structural strength. A cleat is attached to the unit body sole portion intermediate region, and there is a gap in the rib-like structure to facilitate engagement of the cleat with a pedal. The unit body additionally includes an upwardly-extending sidewall terminating the sole portion perimeter region, and forming a portion of the shoe upper.

The downwardly-extending ridge structure and the upwardly-extending sidewalls result in an extremely stiff yet lightweight structure, and also in a relatively thin sole, for reduced stack height, together resulting in enhanced pedaling efficiency.

The cycling shoe of the invention includes further shoe upper components, attached to the upwardly-extending sidewall. These further upper shoe components include a stiffened and contoured tongue piece and adjustable straps for pressing the tongue piece down against the forefoot of the cyclist, thereby clamping the foot of the cyclist between the tongue piece and the unit body, in what may be viewed as a clam shell configuration, without unduly laterally squeezing the foot of the cyclist.

On the unit body are four primary strap attachment points, two of the primary strap attachment points being forwardly positioned, laterally opposite each other in a forefoot position for attaching a strap that extends across the forefoot of the cyclist and over the tongue piece. The two other strap attachment points are rearwardly positioned adjacent the outer heel for attaching straps that extend diagonally from the tongue piece.

For added adjustability, an adjustable heel strap extends across the rear of the shoe between the rearwardly positioned strap attachment points.

For immediately surrounding the foot of the cyclist:, a sock-like liner is attached to the unit body, appropriately padded.

The unit body sole portion intermediate region includes a cleat attachment device, and rubber tread elements are attached to the downwardly-extending ridge structure. The combined height of the downwardly-extending ridge structure and the tread elements is sufficient to provide a recess for a cleat attached to the intermediate region by means of the cleat attachment device.

In one embodiment, the cleat attachment device takes the form of a slotted reinforcement element secured within an aperture in the unit body sole portion intermediate region, and a T-nut engaging the slotted reinforcing element. In another embodiment, the cleat attachment device takes the form of a threaded boss secured to the unit body sole portion intermediate region.

The particular form of the cleat attachment device, as well as the location of the gap in the rib-like structure, depends upon the particular type and manufacturer of the cleat.

The invention accordingly provides an advanced cycling shoe, which offers excellent stiffness, therefore increasing pedaling efficiency. It is lighter than other cycling shoes, increasing overall efficiency of the cyclist and bicycle. The shoe of the invention further offers improved stabilization of the foot into the shoe, likewise providing improved efficiency. The cleat is recessed, allowing fully comfortable walking with most types of pedal cleats available today.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings in which:

FIG. 9C depicts a step in the construction of bonding the tunnel fabrication support of FIG. 9A to the shoe mold of FIG. 9B;

FIG. 9D depicts the build up of various layers of carbon fiber sheets to the underside of the shoe;

DETAILED DESCRIPTION

Figure 1:
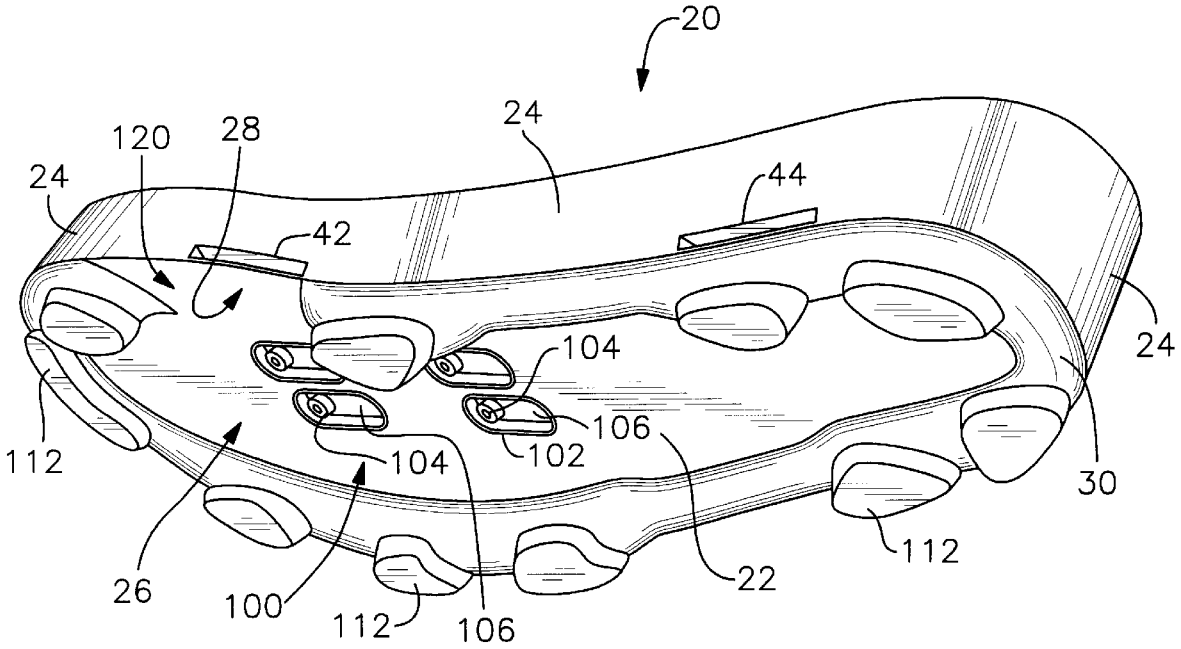
FIG. 1 is a three-dimensional underside view of the unit body of a cycling, shoe in accordance with the invention, additionally showing installed rubber treads and a cleat attachment device.

Referring first to FIGS. 1–5, a cycling shoe 18 includes as its primary element a unit body generally designated 20, including a sole portion 22 and an upwardly-extending sidewall 24. The sole portion 22 includes an intermediate region, generally designated 26, and a perimeter region 28 terminated by the upwardly-extending sidewall 24. Extending along and defining a substantial portion of the perimeter region 28 is a downwardly-extending ridge structure 30. As can be seen in the longitudinal cross-section of FIG. 5, the sole portion intermediate region 26 is flat along approximately the rear two-thirds, and is curved upwardly along the forefoot and toe area.

The downwardly-extending ridge structure 30 varies in height from approximately 0.4 inches to 0.8 inches, with the minimum height being at the toe, and the maximum height being approximately one-third of the way to the rear. The outside diameter of the downwardly-extending ridge structure 30 is approximately 0.6 inches.

The upwardly-extending sidewall 24 varies in height from a minimum of approximately 0.5 inches to a maximum of 0.7 inches. The sidewall 24 is slightly contoured inwardly around the perimeter of the toe area.

In the illustrated embodiment, the downwardly-extending ridge structure 30 extends all the way to the sidewall 24. However, the rib-like structure 30 also may be positioned slightly inside the periphery of the sole portion 22, resulting in a terrace or step-like configuration (not shown).

Preferably the downwardly-extending ridge structure 30 comprises an outer skin 32, rather than being solid. The downwardly-extending ridge structure 30 is thus also referred to herein as a "tunnel." In the cross-section of FIG. 4, the interior of the rib-like structure 30 is filled with a plastic foam material 34 and a thin layer 36 of fiberglass/resin composite, which together serve during fabrication as a support which defines the shape of the rib-like structure 30. With other fabrication techniques, the foam core 34 and the fiberglass/resin composite layer 36 may be omitted.

The unit body 20 thus replaces the sole and part of the upper of a traditional shoe. The unit body 20 is a contoured sheet, and serves as the outsole of the shoe.

Figure 4:
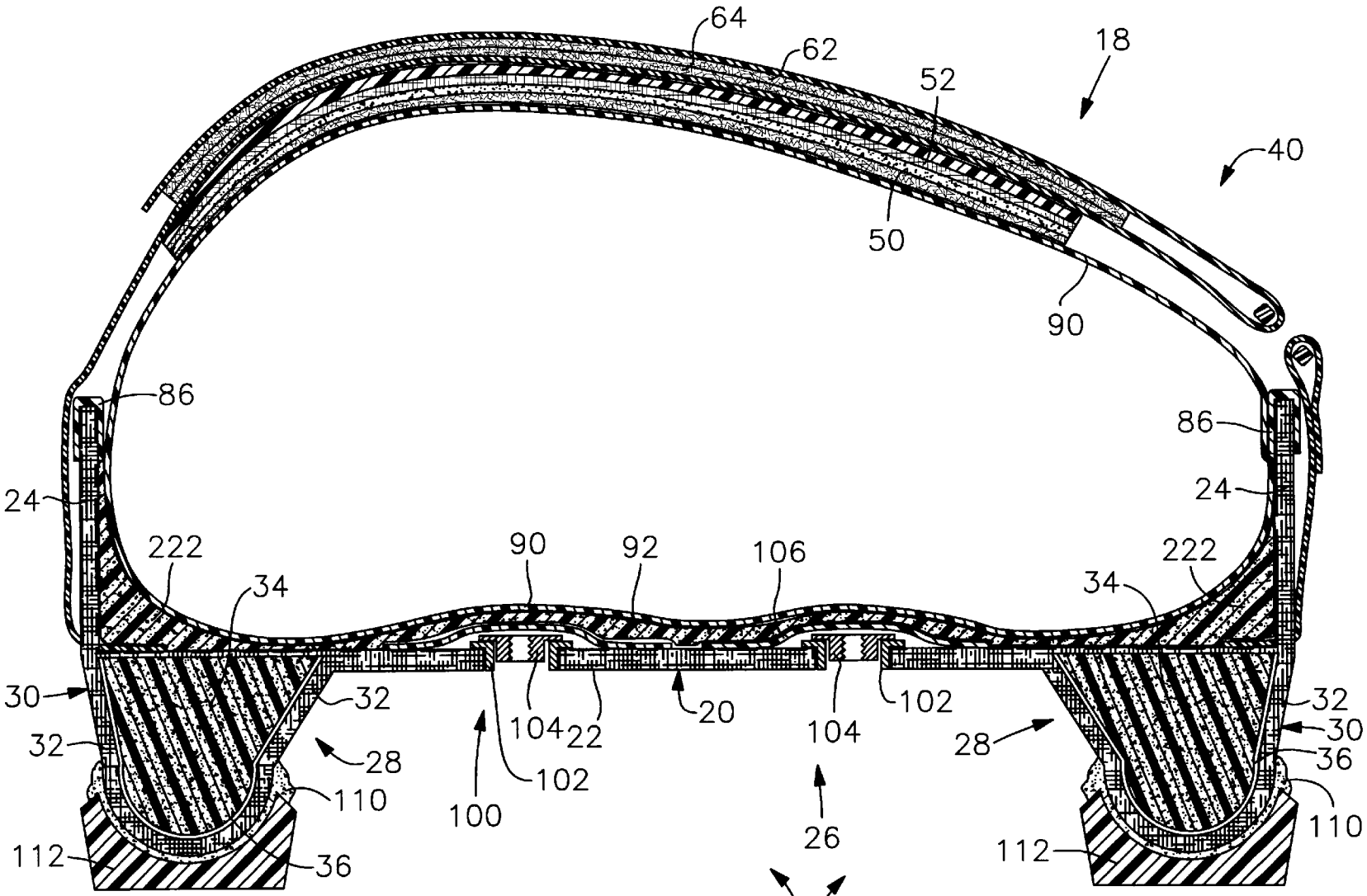
FIG. 4 is a lateral cross-section taken on line 4—4 of FIG. 2.
Figure 5:
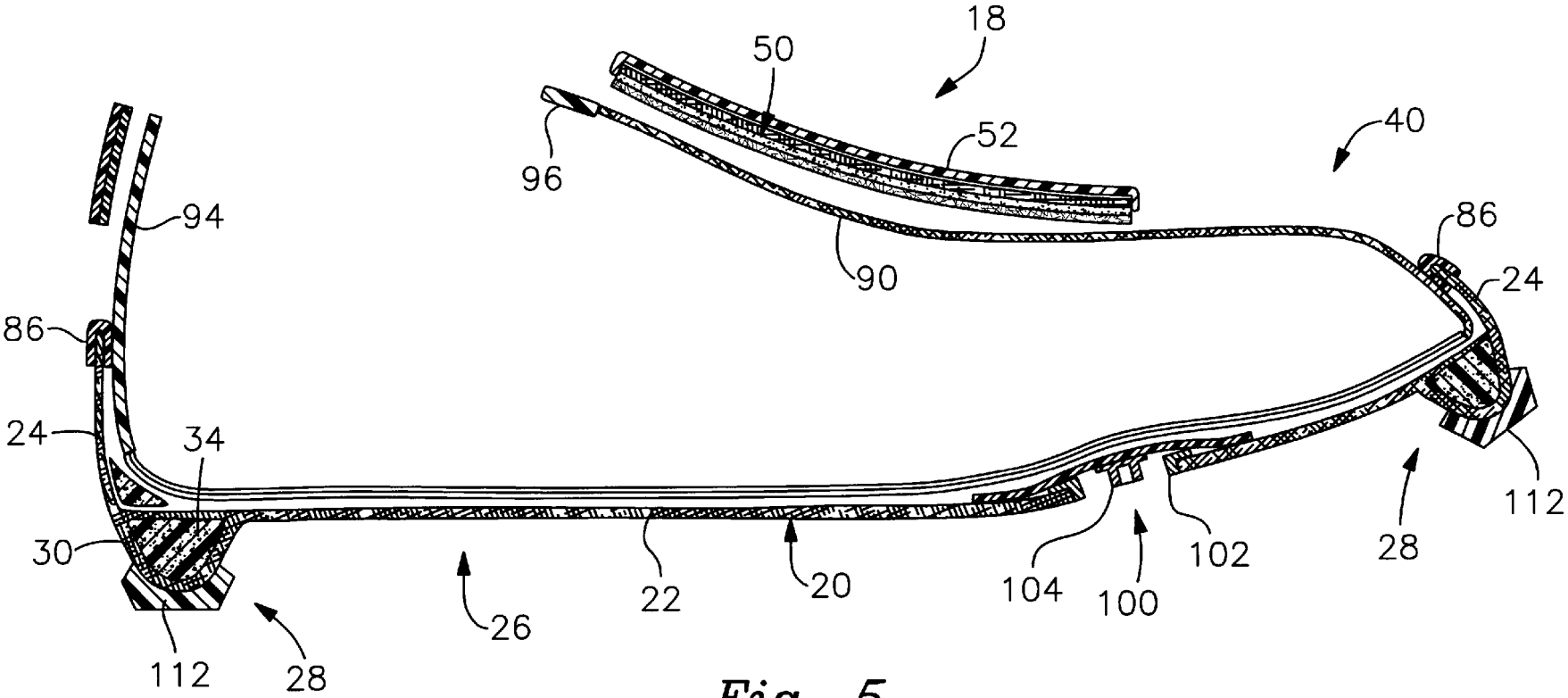
FIG. 5 is a longitudinal cross-section, taken generally on line 5—5 of FIG. 2, showing however only one cleat attachment device for simplicity of illustration.

Although not shown in FIGS. 4 and 5, the unit body 20 varies in thickness from a minimum of approximately 0.04 inches to a maximum of 0.11 inches, being thicker in those regions where additional strength is required, and being thinner in order to save weight in those areas where stresses are not as high. An overall sole thickness, including all padding layers, as low as 0.18 inches (4.5 mm) can be achieved.

In the fabrication method described hereinbelow, the unit body 20 is made of a fiber and resin composite, employing carbon fiber, Kevlar and epoxy resin. However, the unit body 20 alternatively may be made of injection molded plastic, molded with or without embedded fibers for additional strength and rigidity.

A characteristic of the unit body 20 is exceptional stiffness, while at the same time the unit body 20 is extremely light in weight. This is due not only to the materials employed, but to the beam-like structure defined by the upwardly-extending sidewall 24 and the rib-like structure 30.

Various shoe upper components, generally designated 40, are attached to the upwardly-extending sidewall 24, at slot locations 42, 44, 46 and 48, which comprise strap attachment points.

As noted above, the unit body 20 comprises a primary element of the cycling shoe. An important secondary element, included among the shoe upper components 40, is a stiffened and contoured tongue piece 50, depicted in cross-section in FIGS. 4 and 5. As may be seen in FIGS. 2 and 3, the stiffened tongue piece 50 is encased within a outer fabric cover 52, and a system 54 of adjustable straps is provided for pressing the tongue piece 50 down against the forefoot of a cyclist, thereby clamping the foot of the cyclist between the tongue piece 50 and the unit body 20. The tongue piece 50 is a fabric lined composite structure, contoured to lie comfortably over the forefoot of the cyclist. The composite, for example, may comprise Kevlar and epoxy, or fiberglass and epoxy.

Figure 3:
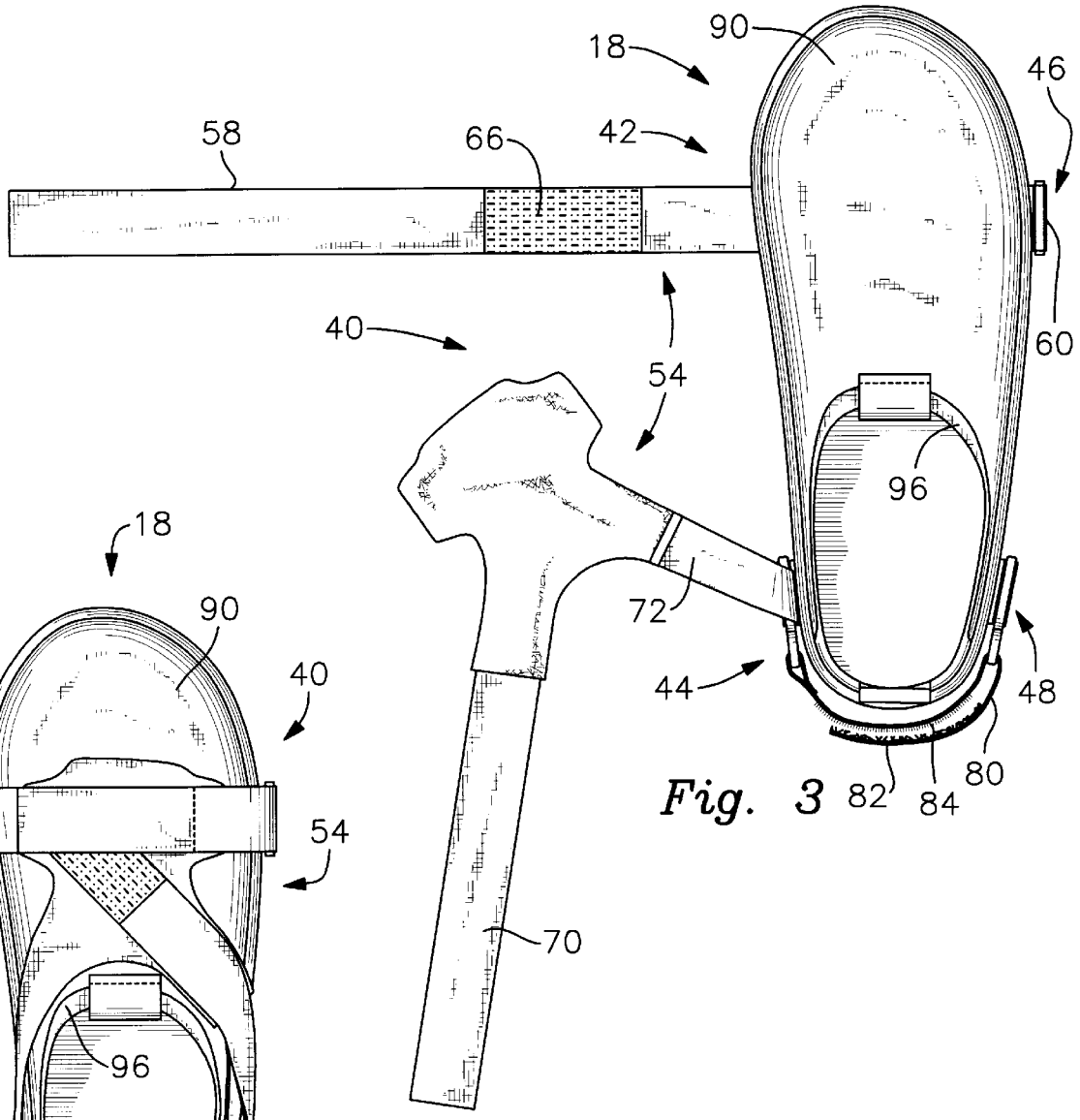
FIG. 3 is a plan view of the shoe of FIG. 2, with the straps partially pulled away to better show the construction.
Figure 2:
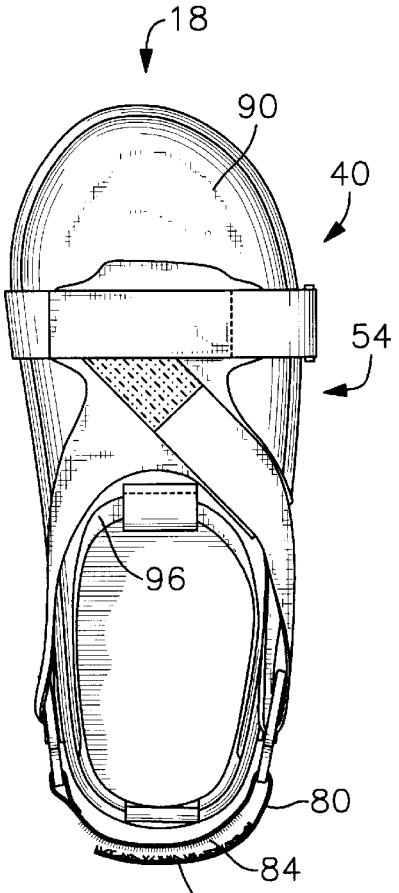
FIG. 2 is a top plan view of an assembled shoe in accordance with the invention.

As best seen in FIGS. 2 and 3, strap attachment points 42 and 46 are forwardly positioned laterally opposite each other in a forefoot position, and secure a strap 58 that extends across the forefoot of the cyclist and over the tongue piece 50. The strap 58 engages a loop 60, and includes mating pieces 62 and 64 of hook and loop fastening material (Velcro) for adjustment purposes. On the underside of the strap 58 is another piece of hook and loop fastening material 66 (Velcro) for securing the strap 58 to the upper part of the tongue piece 50 outer cover 52.

Strap attachment points 44 and 48 are adjacent the heel and serve to attach a pair of diagonal straps 70 and 72 affixed to the tongue piece outer cover 52.

Completing the strapping arrangement, an adjustable heel strap 80, also employing hook and loop fastening material elements 82 and 84 for adjustment, extends just above the heel area of the shoe for further adjustment purposes.

A nylon trim element 86 (FIGS. 4 and 5) caps the upper edge of the sidewall 24. Immediately surrounding the foot of the cyclist, a breathable sock 90 is provided, with a layer of thin foam padding 92 topped with thin fleece immediately underfoot. The sock 90 is glued to the sole, and is also sewn to the nylon trim element 86. A neoprene heel piece 94 is included, as well as a neoprene collar 96.

The unit body 20 sole portion 22 intermediate region 26 includes a cleat attachment device generally designated 100, which can take any one of several different forms depending upon the particular cleat and pedal manufacturer.

In the embodiment of FIGS. 1, 4 and 5, the cleat attachment device takes the form of a slotted reinforcing element 102, machined of aluminum, and machined T-nuts 104 engaging the slotted reinforcing element. To keep dirt out of the inside of the shoe 28 and to retain the T-nuts, a sheet 106 of Cordura fabric is glued around its edges to the unit body sole intermediate region 26.

Attached to the underside of the rib-like structure 30 by means of epoxy glue 110 are a series of rubber tread elements 112.

The combined height of the downwardly-extending ridge structure 30 and the tread elements 112 is sufficient to provide a recess 114 for a cleat (not shown) attached to the sole portion intermediate region by means of the cleat attachment device 110. Accordingly, when the bicyclist is walking rather than riding, the rubber tread elements 112 contact the ground surface, rather than the cleats.

For pedal clearance purposes, the rib-like structure 32 has a gap 120, allowing for pedal interface.

Figure 6:
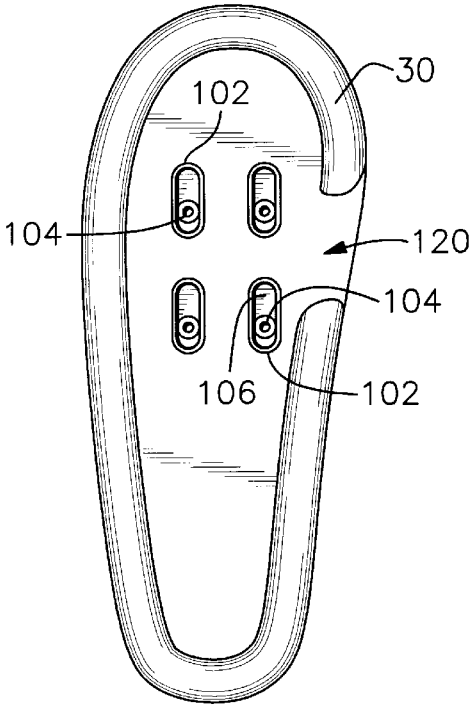
FIG. 6 is a simplified underside view of a shoe depicting one form of cleat attachment device.
Figure 8:
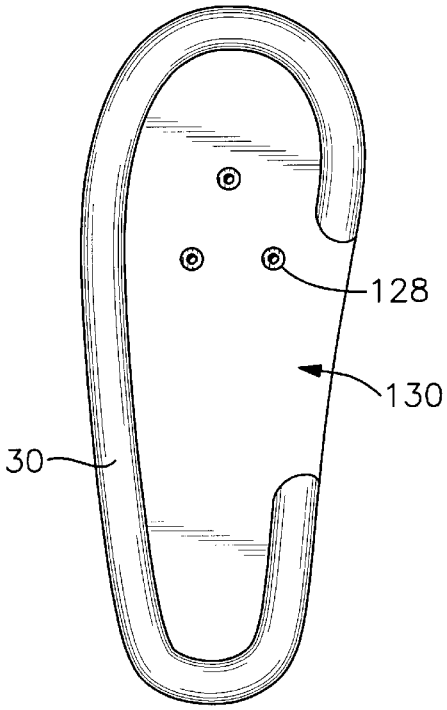
FIG. 8 is a similar underside view depicting yet another cleat attachment device.
Figure 7:
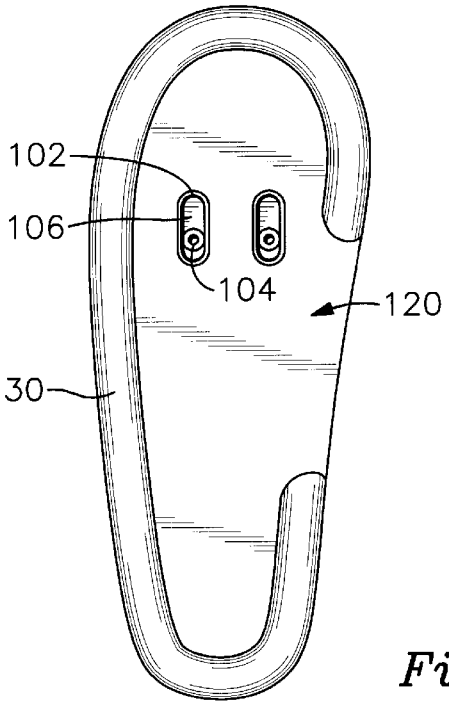
FIG. 7 is a similar view depicting another cleat attachment device.

FIGS. 6, 7 and 8 depict different configurations of cleat attachment devices and gaps 120, depending upon the particular pedal manufacturer.

More particularly, the FIG. 6 configuration is for Speedplay pedals. The T-nuts 104 have 4 mm threads.

FIG. 7 depicts the configuration for SPD and other two-bolt cleats. In this embodiment the T-nuts 104 have 5 mm threads.

FIG. 8 depicts a variation for Look and other three-bolt cleats, where bolt bosses 128 with 5 mm threads are fixed in position, and a different gap 130 configuration is used in the rib-like structure 30. For manufacturing purposes, the bolt bosses 128 are the same as the T-nuts 104.

Referring now to FIGS. 9A through 9H depicting are steps in one method for fabricating shoes in accordance with the invention, and in particular fabricating a unit body 20 comprising fiber and resin composite.

By way of example and not limitation, three different fiber materials are employed. One material is fiberglass, which is woven, and available as a stock material in sheets approximately 0.01 inches thick. Another material is carbon fiber, which is available as a stock material in sheets approximately 0.008 inches in thickness, comprising unidirectional carbon fibers, held together by polyester fibers running perpendicular to the carbon fibers. A third fiber material employed is Kevlar, which is woven, and available in sheets approximately 0.015 inches in thickness.

Figure 9A:
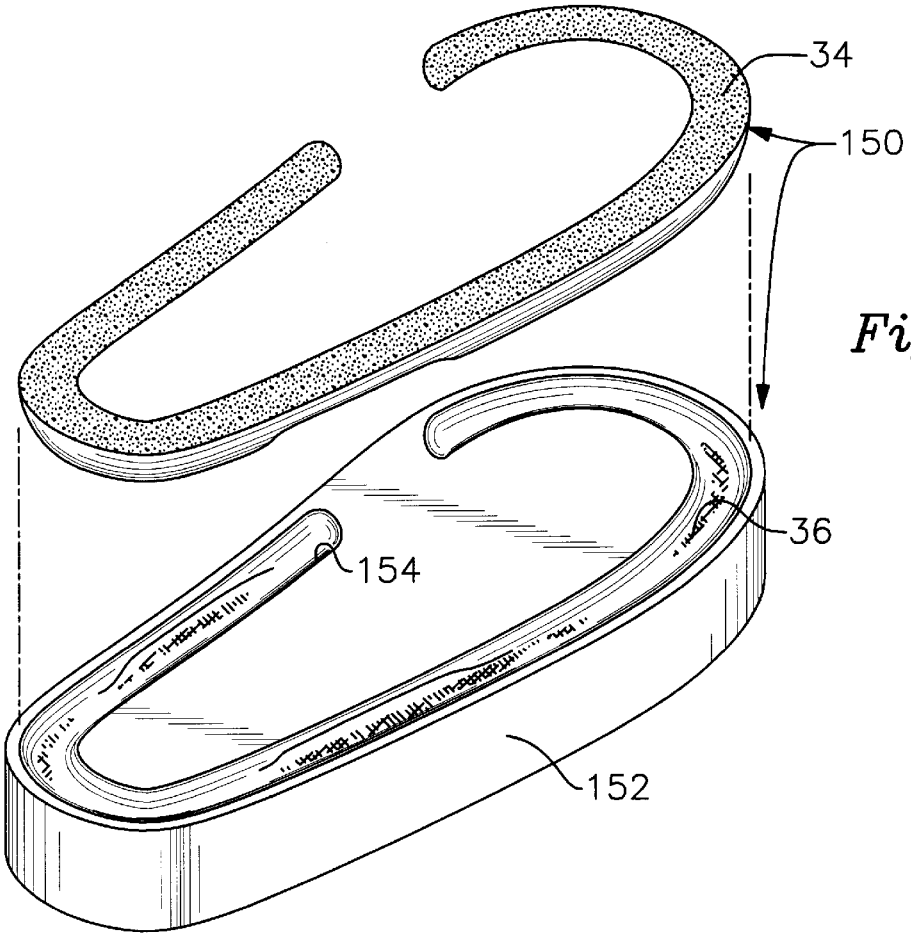
FIG. 9A depicts an initial step in a method of constructing a shoe accordance with the invention, that of constructing a tunnel fabrication support in a mold.

FIG. 9A depicts the preliminary fabrication of a fabrication support element 150, which includes the foam core 34 used to subsequently define the shape of the rib-like structure 30. The foam core 34 is not a structural element in the sense of providing strength in the finished structure of the unit body 24, but aids in the fabrication of the illustrated embodiment.

A female mold 152 is employed, including a groove 154. The groove 154 is first lined with a fiberglass epoxy composite 36. Then foam, such as expanding spray foam intended for insulation purposes, is applied within the groove 154, and the element 150 is allowed to cure.

Figure 9B:
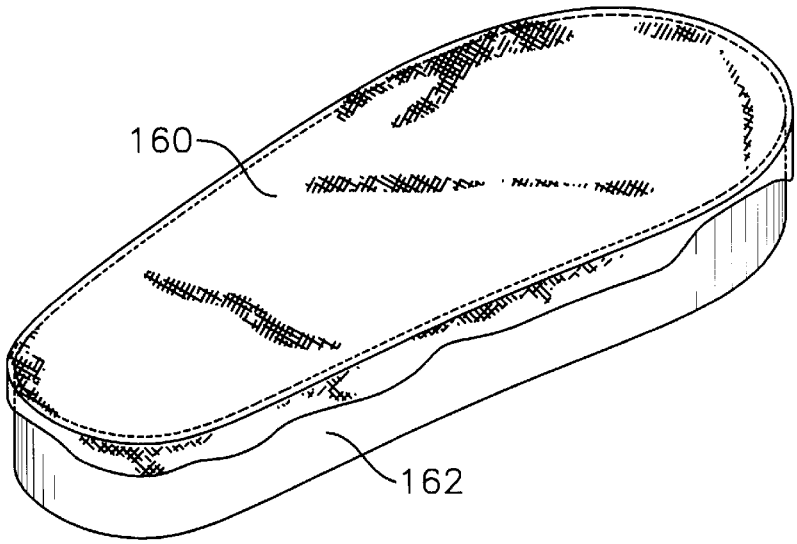
FIG. 9B depicts an initial step of applying a layer of woven fiber material over a shoe mold to form a unit body precursor.

In FIG. 9B, a layer of Kevlar 160 is bonded to a wood shoe mold 162, to begin the actual unit body fabrication process, and in FIG. 9C the fabrication support 150 with the fiberglass 36 surface facing up, is bonded to the Kevlar layer 160.

FIG. 9D depicts the built-up of carbon fiber sheets, wetted out with epoxy, and laid out over the shoe mold 162, on top of the Kevlar layer 160 and by way of tunnel precursor 150.

In order, the first carbon fiber sheet 160 is approximately nine inches long, with the fibers running across. The next piece 172 is also approximately nine inches long, with the carbon fibers oriented lengthwise.

Next are toe and heel coverage pieces 174 and 176, with the fibers running lengthwise.

A shorter piece 178 is next applied, approximately six inches long over the front two-thirds of the shoe, oriented with the fibers running across, followed by a piece 180 of the same size, oriented with the fibers running lengthwise. This adds additional thickness and strength in the cleat attachment region, while avoiding unnecessary weight towards the rear of the shoe.

Finally, a piece 182 with the fibers running across is applied, approximately three inches long, followed by a piece 184 of the same size, oriented with the fibers running lengthwise.

Figure 9E:
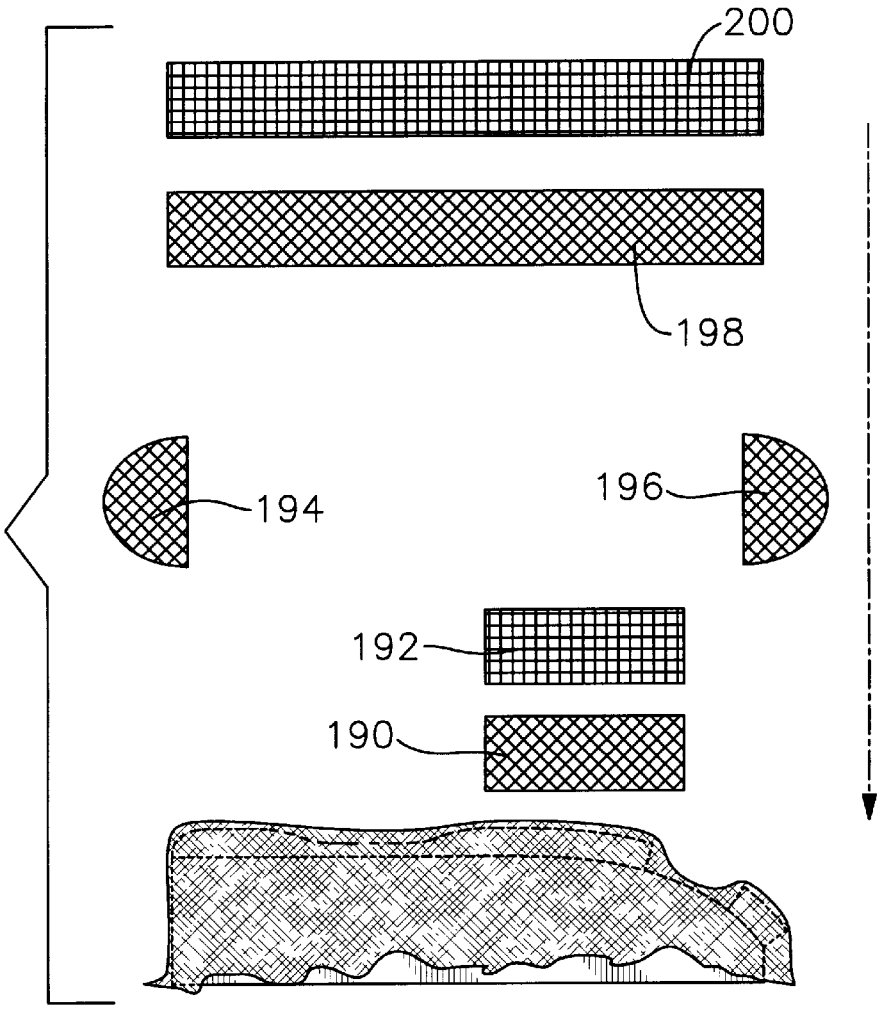
FIG. 9E depicts the build up of several layers of Kevlar sheets to the underside of the shoe.

FIG. 9E depicts a subsequent process, where Kevlar layers, also wetted with epoxy, are layered on top, over the still uncured and wet carbon fiber layers of FIG. 9D. The first Kevlar layer 190 is approximately three inches long, and is oriented with the fibers running diagonally. This is followed by a sheet of piece 192 of the same size, oriented with the fibers running at right angles along the length and across the width of the shoe.

Next, heel and toe cap layers 194 and 196 are applied, with the layer fibers oriented diagonally, followed finally by strips 198 and 190 oriented with the fibers running diagonally and at right angles along the length and across the width of the shoe respectively.

Figure 9F:
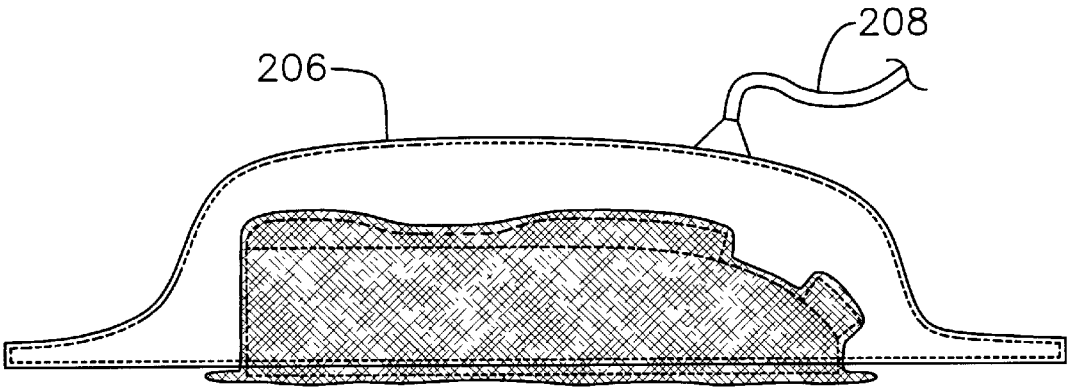
FIG. 9F depicts the step of curing the unit body precursor under vacuum.

FIG. 9F depicts a curing process, where the entire structure is put under a vacuum bag 206 attached to a vacuum tube 208, until cured. Although shown away from the shoe precursor structure for purposes of illustration, it will be appreciated that the vacuum bag 206 presses tightly against the structure, compressing the layers together, and forming the final shape. During this process, the previously cured fiberglass/resin composite layer 36 resists the compressive forces, preventing collapsing of the foam core 34 defining the shape of the rib-like structure 30 during the fabrication process.

Figure 9G:
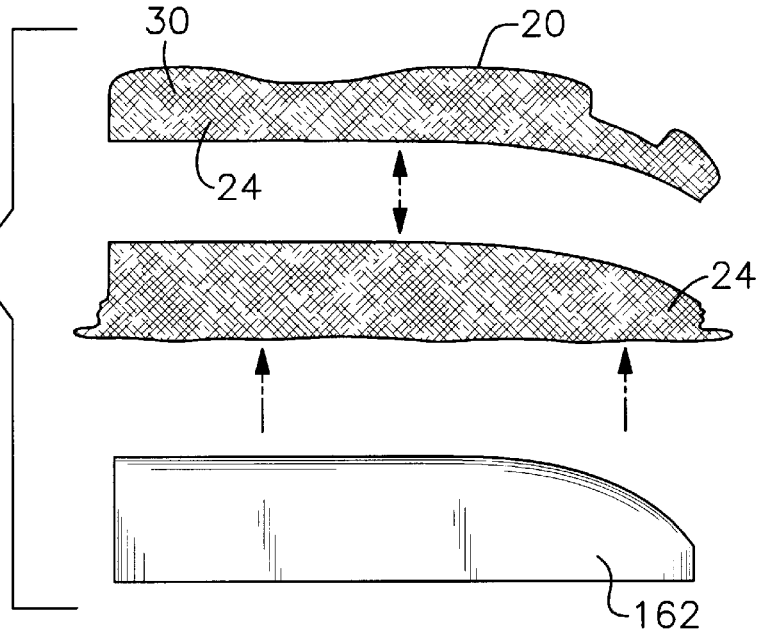
FIG. 9G depicts a step of removing the unit body precursor from the shoe mold, and trimming.

In FIG. 9G, the unit body structure is removed from the mold, and trimmed to define the upper edge of the sidewall 24, resulting in a scrap piece 214.

Figure 9H:
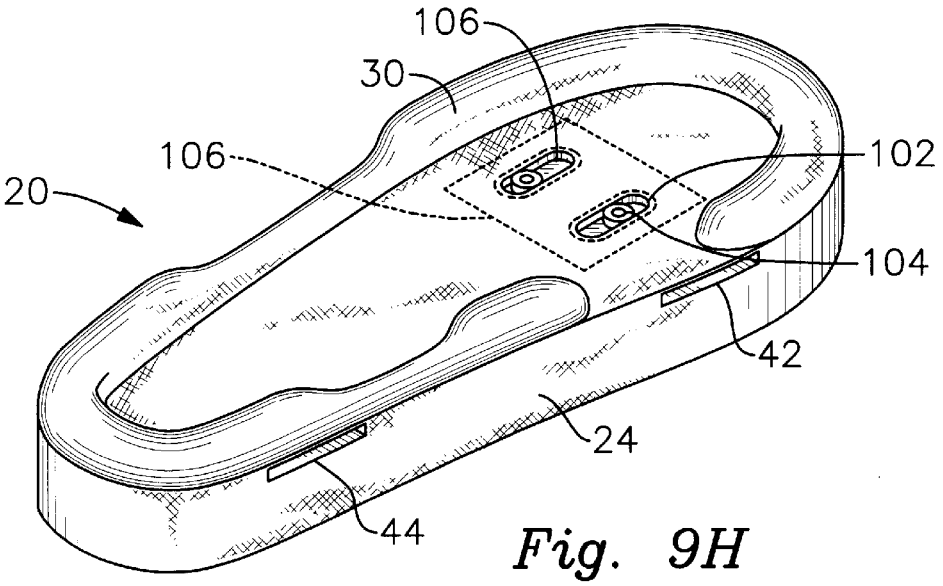
FIG. 9H depicts a subsequent method step.

In FIG. 9H, the holes are drilled, and the slotted reinforcing elements are cut in. Slots are cut in the sidewalls. The Cordura sheet 106 is glued over the mounting slots, from the inside of the shoe. Straps are bonded onto the inside of the surface of the structure through slots. The nylon trim strip 86 is glued to the exposed edge. The outside surface is epoxy coated.

Figure 10:
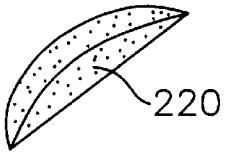
FIG. 10 depicts an arch insert made of foam in isolation.
Figure 11:
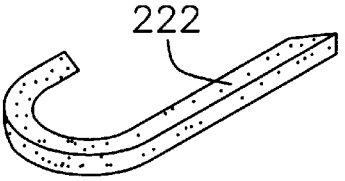
FIG. 11 depicts a heel foam insert, in isolation.

Next, the foam arch insert 220 of FIG. 10 and the heel foam insert 222 of FIG. 11 are glued in. A breathable sock 90 with thin foam padding is glued in. The sock is hand sewn to the structure using the trim strip 106. Finally, the tread elements 112 are glued in.

While specific embodiments of the invention have been illustrated and described herein, it is realized that modifications and changes will occur to those skilled in the art. It is therefore to be understood that the appendant claims are intended to cover all such modifications and changes that fall within the true spirit and scope of the invention.

What is claimed is:

1. A cycling shoe comprising:

a rigid unit body including a sole portion having an intermediate region and a perimeter region, with an integral downwardly-extending ridge structure extending along and defining a substantial portion of said perimeter region, and an integral upwardly-extending sidewall terminating said sole portion perimeter region and forming a portion of a shoe upper; said unit body sole portion intermediate region including a cleat attachment device; and further shoe upper components attached to said upwardly-extending sidewall.

2. The shoe of claim 1, wherein said downwardly-extending ridge structure comprises an outer skin.

3. The shoe of claim 1, wherein said unit body comprises a fiber and resin composite.

4. The shoe of claim 2, wherein said unit body comprises a fiber and resin composite.

5. The shoe of claim 1, wherein said further shoe upper components include a contoured tongue piece, and straps for pressing said tongue piece down against the forefoot of a cyclist, thereby clamping the foot of the cyclist between said tongue piece and said unit body.

6. The shoe of claim 5, which comprises four primary strap attachment points on said unit body, two of said primary scrap attachment points being forwardly positioned laterally opposite each other in a forefoot position for attaching a strap that extends across the forefoot of the cyclist and over said tongue piece, and two other of said strap attachment points being rearwardly positioned adjacent the outer heel for attaching straps that extend diagonally from said tongue piece.

7. The shoe of claim 6, which comprises a heel strap that extends across the rear of said shoe between said rearwardly positioned strap attachment points.

8. The shoe of claim 5, which further comprises a liner attached to said unit body for surrounding the foot of the cyclist.

9. The shoe of claim 1, which further comprises tread elements attached to said downwardly-extending ridge structure, the combined height of said downwardly-extending ridge structure and said tread elements being sufficient to provide a recess for a cleat attached to said intermediate region.

10. The shoe of claim 9, wherein said cleat attachment device comprises a slotted reinforcing element secured within an aperture in said unit body sole portion intermediate region, and a T-nut engaging said slotted reinforcing element.

11. The shoe of claim 9, wherein said cleat attachment device comprises a threaded boss secured to said unit body sole portion intermediate region.

12. The shoe of claim 1, wherein said cleat attachment device comprises a slotted reinforcing element secured within an aperture in said unit body sole portion intermediate region, and a T-nut engaging said slotted reinforcing element.

13. The shoe of claim 1, wherein said cleat attachment device comprises a threaded boss secured to said unit body sole portion intermediate region.

14. The shoe of claim 1, wherein said downwardly-extending ridge structure has a gap to facilitate engagement of a cleat attached to said unit body sole portion intermediate region with a pedal.

15. The shoe of claim 1, wherein said unit body sole portion intermediate region has a thickness ranging from approximately 0.04 inches to approximately 0.11 inches.

* * * * *